US007481619B2

(12) United States Patent
Obosu et al.

(10) Patent No.: US 7,481,619 B2
(45) Date of Patent: Jan. 27, 2009

(54) EXTENDED VENTURI FAN RING

(75) Inventors: Charles Borromeo Obosu, Oklahoma, OK (US); Mallikarjuna Sarma Chitti, Norman, OK (US)

(73) Assignee: York International Corporation, York, PA (US)

( * ) Notice: Subject to any disclaimer, the term of this patent is extended or adjusted under 35 U.S.C. 154(b) by 364 days.

(21) Appl. No.: 11/201,984

(22) Filed: Aug. 11, 2005

(65) Prior Publication Data

US 2007/0036648 A1 Feb. 15, 2007

(51) Int. Cl.
*F04D 29/52* (2006.01)

(52) U.S. Cl. ..... 415/221; 416/189

(58) Field of Classification Search ..... 416/189, 416/169 A, 238; 415/222, 221.1
See application file for complete search history.

(56) References Cited

U.S. PATENT DOCUMENTS

| | | | | |
|---|---|---|---|---|
| 3,714,795 | A | 2/1973 | Fowell et al. | |
| 3,872,916 | A | 3/1975 | Beck | |
| 3,943,728 | A | 3/1976 | Maudlin | |
| 4,213,736 | A | 7/1980 | Gongwer | |
| 4,470,271 | A * | 9/1984 | Draper et al. | 62/259.1 |
| 4,554,796 | A | 11/1985 | Stankard | |
| 4,657,483 | A | 4/1987 | Bede | |
| 5,066,194 | A * | 11/1991 | Amr et al. | 415/223 |
| 5,215,438 | A * | 6/1993 | Chou et al. | 415/223 |
| 5,342,167 | A * | 8/1994 | Rosseau | 415/119 |
| 5,423,658 | A | 6/1995 | Pla et al. | |
| 5,478,201 | A | 12/1995 | Amr | |
| 5,480,282 | A | 1/1996 | Matson | |
| 5,547,339 | A | 8/1996 | Burgers | |
| 5,615,999 | A | 4/1997 | Sukup | |
| 5,803,709 | A | 9/1998 | Matthews et al. | |
| 5,951,247 | A | 9/1999 | Rockwell et al. | |
| 6,139,265 | A * | 10/2000 | Alizadeh | 415/208.1 |
| 6,481,233 | B1 | 11/2002 | Calvert | |
| 6,499,948 | B1 | 12/2002 | Iyer et al. | |

* cited by examiner

*Primary Examiner*—Ninh H Nguyen
(74) *Attorney, Agent, or Firm*—McNees Wallace & Nurick, LLC

(57) ABSTRACT

A high efficiency, low-noise fan ring for use with a heat exchanger having an annular fan ring body attached to a coaxial mounting ring. The fan ring body extends in a substantially perpendicular direction from an inner periphery of the mounting ring. The annular body has a circumferential periphery profile defined by a plane coincident the center axis and an inner surface of the fan ring body. The periphery profile includes a transition portion and a curved portion. The transition portion extends in a substantially perpendicular direction from the mounting ring and attaches to an end of the curved portion. In order to reduce noise and increase uniformity of airflow, the length of the curved portion of the periphery profile is sufficient long to reduce recirculation of air entering the fan ring body.

18 Claims, 8 Drawing Sheets

EXTENDED VENTURI FAN RING

FIELD OF THE INVENTION

The present invention is directed to a fan ring for use with a fan. In particular, the present invention is directed to a fan ring for use with a fan in a heat exchanger application.

BACKGROUND OF THE INVENTION

Heating Ventilation Air-conditioning and Refrigeration (HVAC & R) systems typically include a heat exchanger unit, e.g., an outdoor unit, having a fan arranged to draw air over a heat exchanger. After being drawn over the heat exchanger coil, the air is moved by the fan through a fan ring, where the air is generally exhausted to the atmosphere. The fan ring provides a path through which air may leave the heat exchanger unit. The fan ring typically includes a geometry that provides diffusion of the air in order to reduce the amount of power required by the fan.

A conventional fan ring with a bell-mouth shape results in undesirable recirculation of the air within the heat exchanger unit and more turbulent airflow profiles. The recirculation of the air undesirably concentrates the flow of air in certain portions of the heat exchanger coil and prevents adequate airflow in other portions of the heat exchanger coil. The portions the heat exchanger that do not receive adequate airflow exchange less heat and reduce the efficiency of the heat exchanger unit. In addition, the turbulent airflow profile undesirably results in a large amount of noise being produced by the heat exchanger unit.

Fan rings, such as the fan ring described in U.S. Pat. No. 5,615,999 to Sukup, hereafter referred to as Sukup, which is herein incorporated by reference in its entirety, have been used as air flow management systems for use in conjunction with fans. Sukup describes a vane axial fan housing having an inlet end and an outlet end. The inlet end has an inlet opening circumscribed by an adjacent venturi-shaped flange integrally formed in the inlet endplate. The venturi shape of the flange extends away from the inlet end and toward the outlet end. A drawback to the cross-sectional shapes, such as the one shown in Sukup, is that the airflow through the unit is not uniform and recirculation near the inlet end of the fan housing prevents efficient flow of air through the fan housing. In addition, the fan and the flow of air through the fan ring results in a large amount of noise.

What is needed is a fan ring structure that provides a substantially uniform airflow across the heat exchanger coil of a heat exchanger unit to provide increased efficiency, while decreasing the amount of noise generated by the fan and the air flowing through the fan ring.

SUMMARY OF THE INVENTION

The present invention is directed to a high efficiency, low-noise fan ring for use with a heat exchanger having an annular fan ring body attached to a coaxial mounting ring. The fan ring body extends in a substantially perpendicular direction from an inner periphery of the mounting ring. The annular body has a circumferential periphery profile defined by a plane coincident the center axis and an inner surface of the fan ring body. The periphery profile includes a transition portion and a curved portion. The transition portion extends in a substantially perpendicular direction from the mounting ring and attaches to an end of the curved portion. In order to reduce noise and increase uniformity of airflow, the length of the curved portion of the periphery profile is sufficiently long to reduce recirculation of air entering the fan ring body.

The present invention is directed to a high efficiency, low-noise heat exchanger having an annular fan ring body attached to a coaxial mounting ring. The fan ring body extends in a substantially perpendicular direction from an inner periphery of the mounting ring. The annular body has a circumferential periphery profile defined by a plane coincident the center axis and an inner surface of the fan ring body. The periphery profile includes a transition portion and a curved portion. The transition portion extends in a substantially perpendicular direction from the mounting ring and attaches to an end of the curved portion. The heat exchanger includes a fan having one or more fan blades. The fan is positioned so that the fan blade center axis intersects the curved portion of the periphery profile at a point where the curved portion defines a minimum inner diameter for the fan ring body.

The extended venturi fan ring structure allows the airflow entering the fan ring structure to flow through the structure with an aerodynamic profile that is smoother, less turbulent, and has less recirculation than a conventional fan ring structure. The smooth flow profile and reduced recirculation reduce the amount of sound produced by the fan and the fan ring.

Another advantage of the present invention is that the extended venturi fan ring structure provides a substantially uniform flow of air across the heat exchanger coils of a heat exchanger unit where the recirculation of air within the heat exchanger unit is reduced.

Another advantage of the present invention is that the shape of the extended venturi structure allows easy manufacture at a lower cost. The shape of the extended venturi structure is easily manufactured using conventional manufacturing techniques. The use of conventional manufacturing techniques allows the fan ring structure to be produced relatively inexpensively.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

Figure 1:
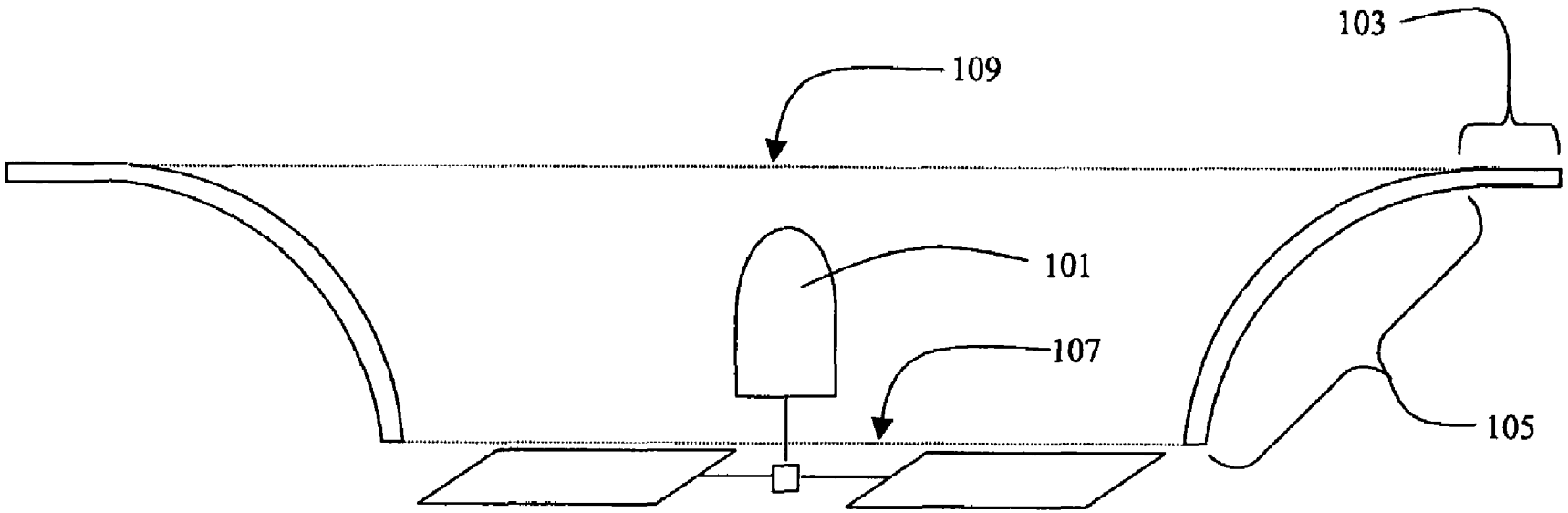
Figure 1 (prior art)
FIG. 1 shows a known fan ring having a bell-shaped geometry.

FIG. 1 shows a known fan ring, commonly referred to as a bell-mouth diffuser. The fan ring shown in FIG. 1 includes a fan 101, mounting ring 103, a curved portion 105, an inlet end 107 and an outlet end 109. The air moved by the fan 101 is forced through the inlet end of the fan ring toward the outlet end 109. The geometry of the fan ring of FIG. 1 includes an increasing fan ring diameter with the distance from the fan blades, commonly referred to as a bell-mouth geometry. The air diffuses as the diameter of the fan ring increases. At the inlet end 107, a portion of the air moved by the fan 101 recirculates and does not enter the fan ring structure. This recirculation is a result of the shape of the diffuser. At the inlet end 107, the curved portion 105 forms an area in which air from the fan is split. A portion of the air is directed to the outside surface of the curved portion and another portion enters the inlet end of the diffuser. This split is due to the sharp terminus of the curved portion 105 at the inlet end 107. When the fan ring is mounted in a heat exchanger unit, the recirculating air decreases the amount of air from being drawn over certain portions of the heat exchanger coil of the heat exchanger unit. The recirculating air creates an uneven flow of air across the heat exchanger coils because the recirculating air directed to the outside surface of the curved portion 105 flows in a direction obstructing the flow of air passing over the heat exchanger coils. For example, the recirculating air results in a flow of air that is substantially perpendicular to the air flow passing over the heat exchanger coils near the diffuser, causing the flows to intersect, creating a backpressure that reduces the flow entering the heat exchanger at that location. In addition, the recirculating air is turbulent and produces a large amount of noise. However, the noise created does not only result from the recirculating air near the intake of the fan ring. As the air diffuses near the outlet end 109, the air loses velocity and becomes more laminar. The air leaving the diffuser creates a large of amount of noise. When the known fan ring having the bell-mouth cross-sectional geometry is installed in an HVAC heat exchanger unit, the noise produced typically exceeds 72 decibels (dBA).

Figure 2:
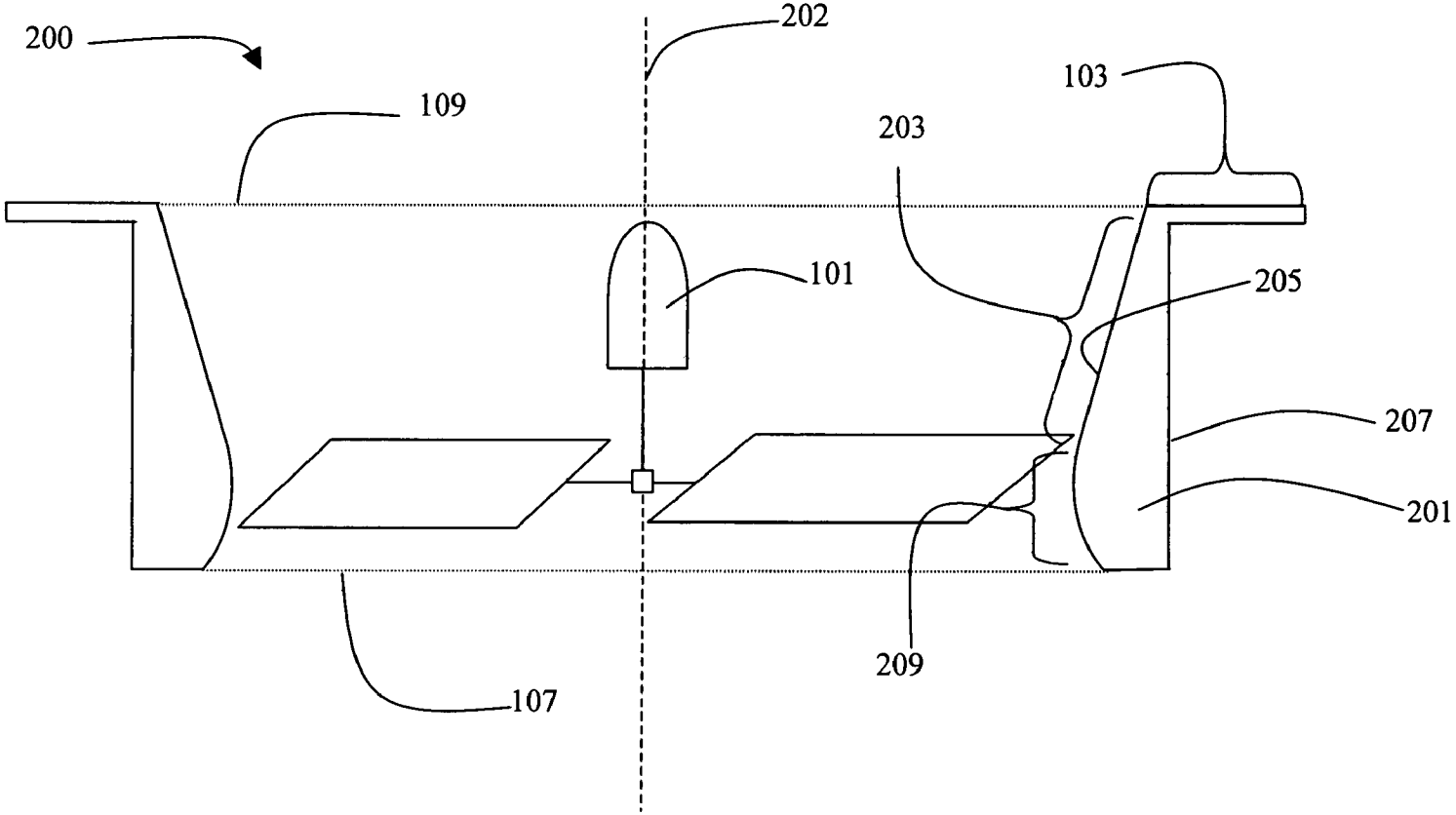
FIG. 2 shows a cutaway view of a fan ring structure according to an embodiment of the present invention.

FIG. 2 shows a fan ring structure 200 according to an embodiment of the present invention. This fan ring structure 200 provides diffusion of the air, while reducing the amount of sound as compared to conventional fan rings. The fan ring structure 200 includes a fan ring body 201 attached to a mounting ring 103. The mounting ring 103 provides a surface for attachment to a heat exchanger or other device. The fan ring body 201 has an annular geometry surrounding a center axis 202. FIG. 2 shows a cutaway view of the fan ring body 201, including a circumferential periphery profile and an interior surface 205. The embodiment shown in FIG. 2 also includes an outer surface 207 that extends perpendicularly from the mounting ring 103, forming a cylindrical geometry. The circumferential periphery profile is a cross section of the fan ring body 201 taken in a plane parallel and intersecting center axis 202. The interior surface 205 includes two portions, a transition portion 203 and a curved portion 209. The transition portion 203 is a substantially conical surface extending from the mounting ring 103. The transition portion 203 extends in a direction parallel to the center axis substantially perpendicular to the mounting ring 103. As the transition portion 203 extends from the mounting ring 103, the transition portion converges toward center axis 202 at a substantially linear rate from the mounting ring 103, i.e., the slope of the transition portion 203 is substantially constant. The resultant geometry of the transition portion 203 is a frusto-conical shape extending from the mounting ring 103. At the end of the transition portion 203 distal to the mounting ring 103, the transition portion 203 is attached to the curved portion 209. The curved portion 209 includes a surface that has a curved geometry extending from the transition portion 203. The length of the arc of the curved portion 209 may be any length that provides the desired airflow, including an airflow having an increased laminar flow profile at the inlet end 107 and the outlet end 109 and minimizes recirculation near the inlet end 107. FIG. 2 shows the curved portion 209 forming a minor arc having a predetermined radius of curvature. Although FIG. 2 shows the curved portion 209 as having a single predetermined radius of curvature, the curved portion in not limited to a single radius of curvature. In one embodiment according to the present invention, the predetermined radius of curvature is about 1.4 to about 1.6. In a preferred embodiment, the predetermined radius of curvature is 1.5. Other curved geometries that are suitable for use as the curved portion 209 include elliptical geometries. The radius of curvature, either for the predetermined radius of curvature or the elliptical geometries, is sufficiently large to provide the reduced recirculation of air and reduced noise, but sufficiently small to provide a height profile useful for use installation in combination with, for example, heat exchanger units. In a preferred embodiment, the curved portion 209 includes an elliptical geometry extended in a direction perpendicular to the mounting ring 103. The geometry of the inner surface 205 including the transition portion 203 and the curved portion 209 results in a noise level reduced by 6-8 dBA compared to a bell-shaped fan ring, such as the fan ring shown in FIG. 1. The overall noise produced by the fan ring structure 200 according to the present invention in operation is preferably 60-68 dBA. More preferably, the noise produced by the fan ring structure 200 according to the present invention is 64-66 dBA. Additional dBA reductions beyond cited numbers are achievable by increasing fan diameter and reducing fan rpm A fan 101 is provided to move air through the fan ring structure 200. Although FIGS. 2-8 show a fan 101 as an air moving device, any air moving device may be used in conjunction with the fan ring body 201 of the present invention. Other suitable air moving devices include, but are not limited to blowers, propellers or impellers. The fan 101 moves the air through the fan ring structure 200. The air is drawn into the fan ring structure 200 and contacts the curved portion 209 of the fan ring structure 200. The air velocity is increased because the air is forced into a more narrow area defined by the curved portion 205 of the fan ring structure 200. As the velocity of the air increases and as the air enters the restricted area defined by the curved portion 205, the pressure of the air decreases. As the air travels into the area bounded by the transition portion, the pressure of the air increases and the velocity of air decreases. The length of the extension of the transition portion 203 provides a surface that minimizes the transition from the lower pressure high velocity air to the higher pressure low velocity air. The transition provided by the transition portion 203 provides a aerodynamic airflow profile that has greater laminar characteristics.

Figure 3:
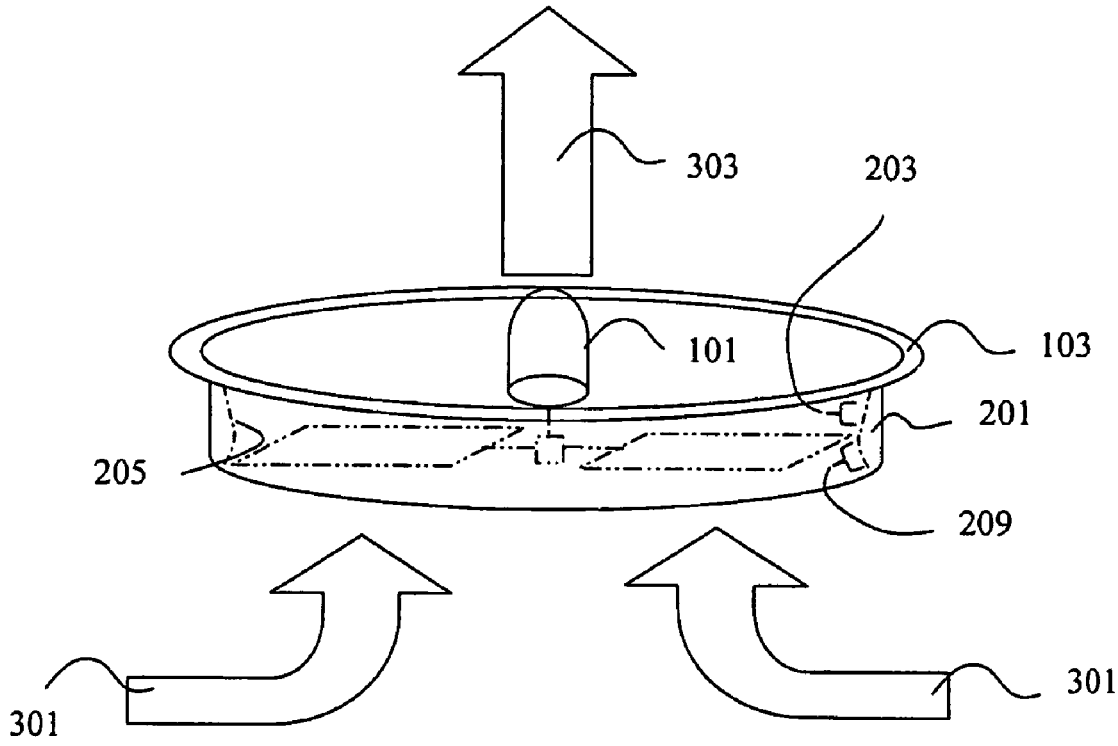
FIG. 3 shows a perspective view of a fan ring structure according to an embodiment of the present invention. to another embodiment of the present invention.

FIG. 3 shows a perspective view of a fan ring structure 200 according to an embodiment of the invention. The fan 101 draws intake air 301 through a fan ring body 201 and exhausts the air as exhaust air 303. The air flows through fan ring structure 200 as shown and described with respect to FIG. 2. The curved portion 209 allows the entry of intake air 301 into the fan ring structure with a reduced amount of recirculation. The geometry of the curved portion 209 is such that a greater amount of air from the fan 101 is directed into the fan ring structure 200. This is accomplished by providing a geometry that allows less air to be directed to the outside surface 207 of the fan ring structure 200. The decrease in the occurrence of recirculation allows intake air 301 to be more uniform. In particular, when the fan ring structure 200 is mounted onto a heat exchanger unit, the air across the coils is substantially uniform.

Figure 4:
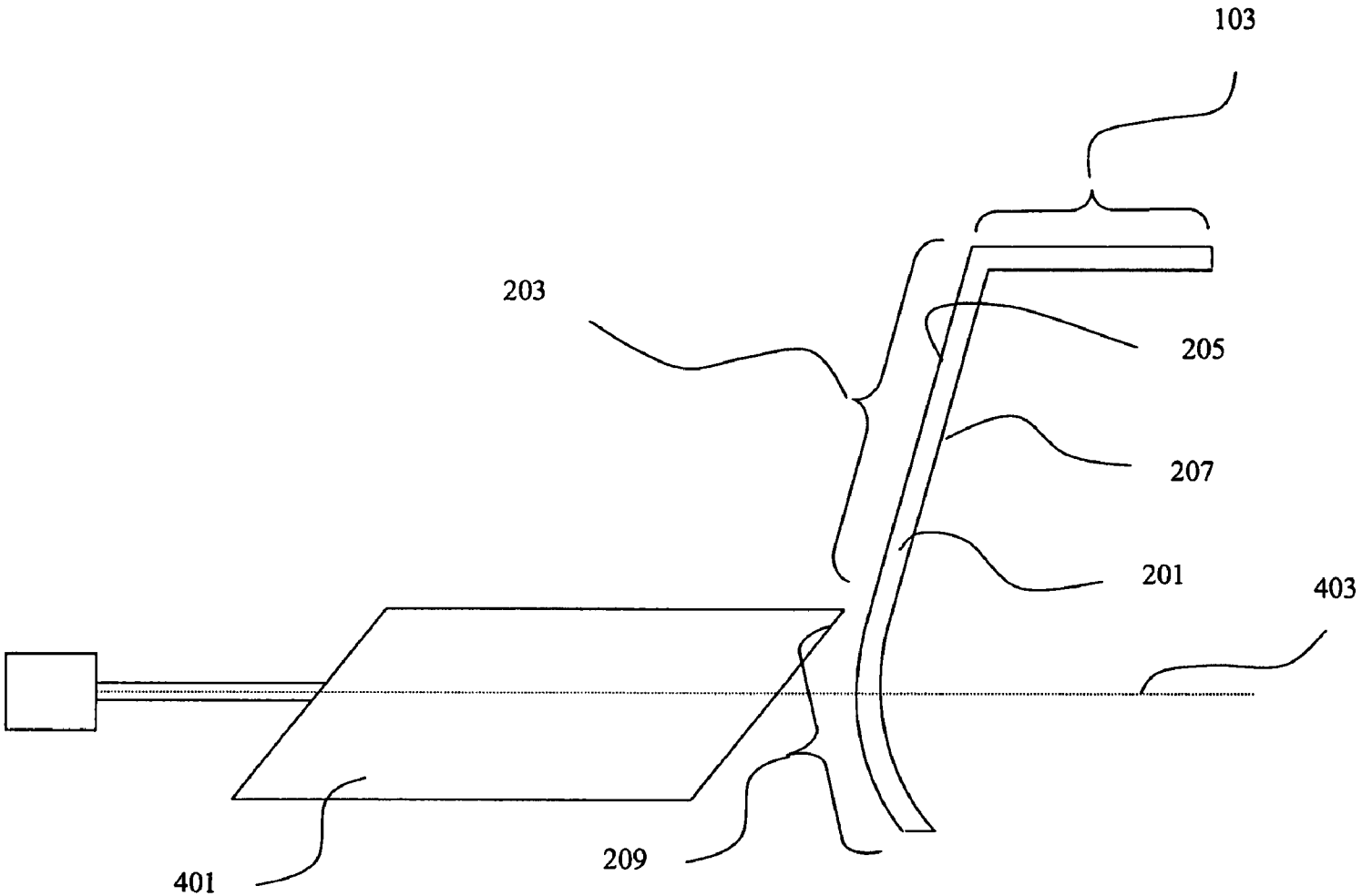

FIG. 4 shows a cross-section of the circumferential periphery profile of the fan ring body 201. Although FIG. 4 shows a fan ring body 201 having an exterior surface 207 that is similar to the geometry of the inner surface, the fan ring body may have any geometry, including a flat exterior surface 207, as shown in FIG. 2. Providing a shaped profile as shown in FIG. 4 has the advantage that the fan ring structure is lighter and takes up less space. A flat exterior surface 207 has the advantage that it is fabricated easily, since only the interior surface 205 requires shaping. FIG. 4 shows the transition portion 203 and the curved portion 209 extending from mounting ring 103. The transition portion 203 extends for a length sufficient to transition the air accelerated from the curved portion 209 and short enough to maintain a height for the fan ring structure 200 that allows installation into a heat exchanger unit. The ratio of transition portion 203 length to curved portion 209 length is preferably 0.7:1 to 1.3:1. In a more preferred embodiment, the transition portion 203 length to curved portion 209 length is greater than 1:1.

FIG. 4 also shows an embodiment including the position of fan blade 401 in relation to the fan ring body 201. The fan 101 is positioned such that a fan blade centerline 403 intersects the curved portion 209 at a point near a minimum diameter of the inner surface 205 of the fan ring body 201. The positioning of the fan 101 and the fan blades 401, provides a decreased noise level and more uniform airflow by decreasing the area available for recirculating air around fan 101 and providing a flow through the fan ring body that is more laminar. Any fan blade geometry may be used for the fan blades 401 of the present invention. A preferred fan blade geometry is a swept-wing fan blade. In a more preferred embodiment, the fan blade is a swept-wing fan blade geometry configured to reduce airflow cavitation. The clearance of the fan blade 401 and the fan ring body 201 is preferably small. In one embodiment the clearance between the fan blade 401 and the fan ring body 201 is about ¼ inch to about ⅛ inch. The resultant noise reduction due to the positioning of the fan is from about 3 to about 8 dB over a fan with fan blades that are near the inlet 107 or outlet 109 of the fan ring structure 200. The total noise reduction of a fan ring structure 200 having the interior surface 205 geometry including the transition portion 203 and the curved portion 209 is about 10 to about 16 decibels over a bell-shaped fan ring, such as the fan ring shown in FIG. 1. Preferably, the noise reduction of a fan ring structure 200 having the interior surface 205 geometry is preferably from about 6 to about 8 dBA.

Figure 5:
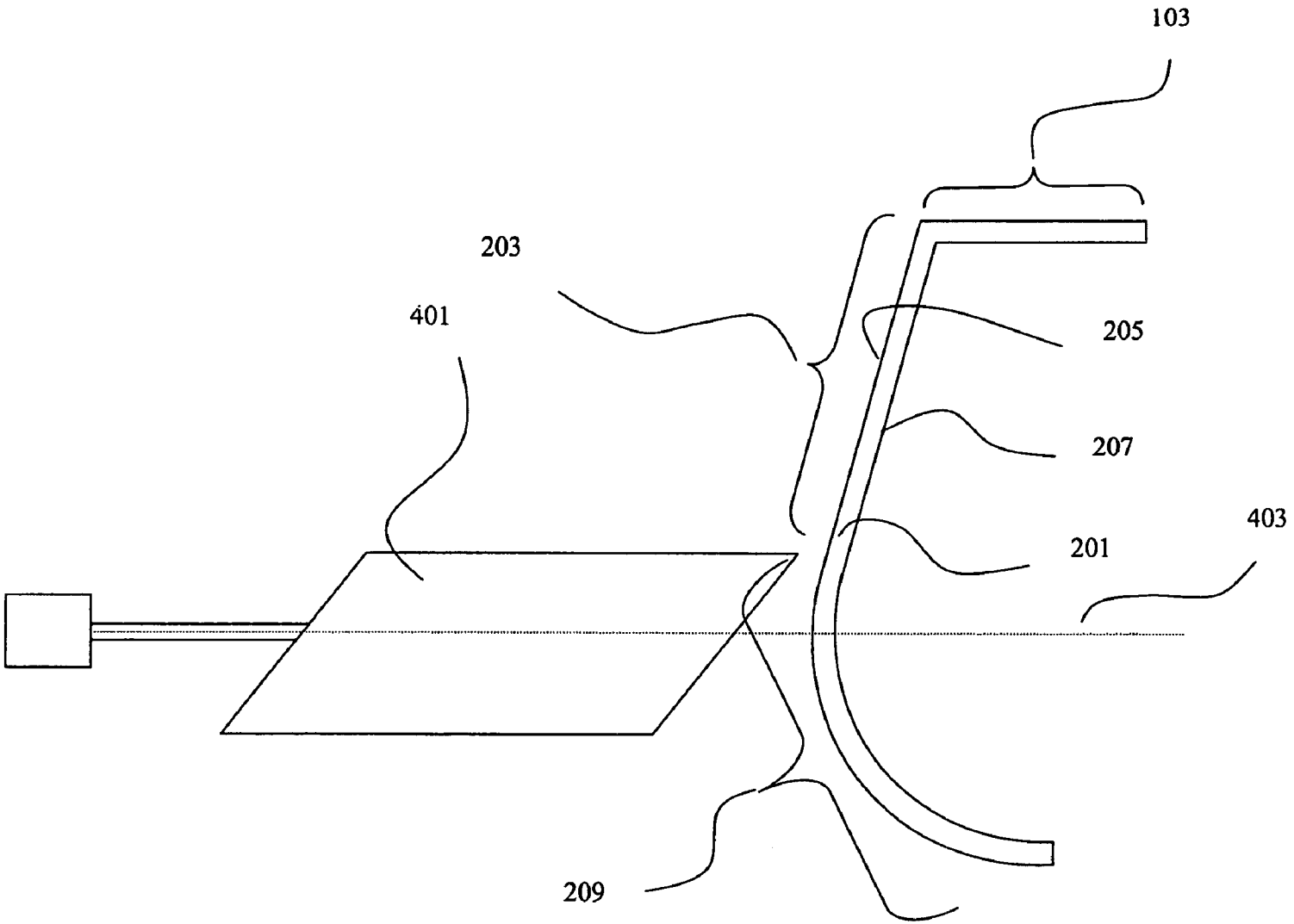
FIG. 5 shows an enlarged cutaway view of a fan ring structure according to still another embodiment of the present invention.

FIG. 5 shows a cross-section of the circumferential periphery profile of the fan ring body 201 having an exterior surface 209 that has a geometry similar to the inner surface 205. FIG. 5 shows the transition portion 203 and the curved portion 209 extending from mounting ring 103, similar to FIG. 4. However, the arc of the curved portion 209 is greater than the arc shown in FIG. 4. The greater arc length provides a greater uniformity of flow of intake air 301. The shorter arc length provides a total height for the fan ring structure that allows installation into heat exchanger units having a reduced size. The transition portion 203 extends for a length greater than the length of the curved portion 209.

Figure 6:
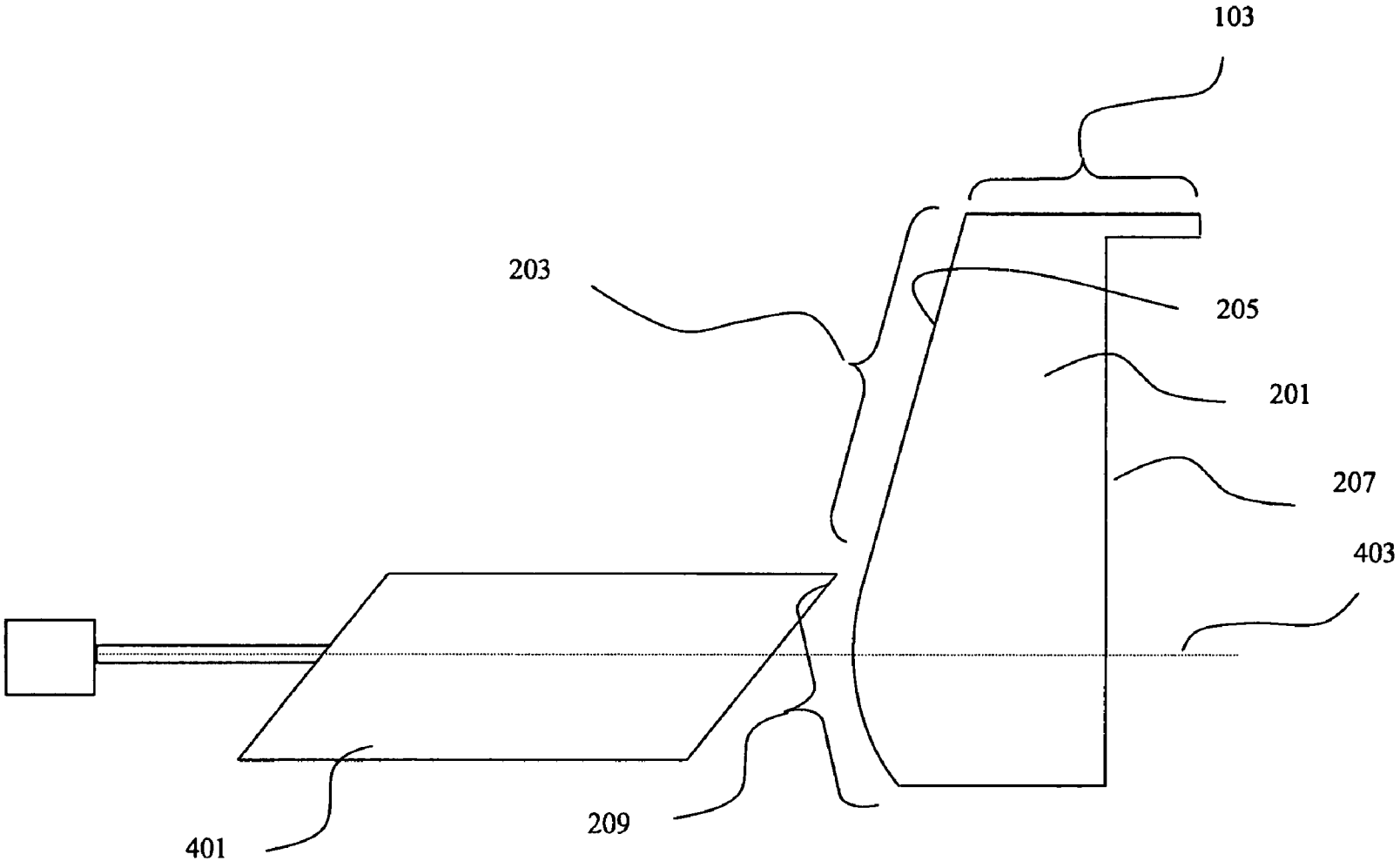
FIG. 6 shows an enlarged cutaway view of a fan ring structure according to still another embodiment of the present invention.

FIG. 6 shows the transition portion 203 and the curved portion 209 extending from mounting ring 103, similar to the embodiment in FIG. 2. The transition portion 203 extends for a length greater than the length of the curved portion 209, similar to FIG. 4. The fan ring body 201 defines a larger cross-section. The outer surface 207 has a geometry that is substantially linear and substantially perpendicular to the mounting ring 103.

Figure 7:
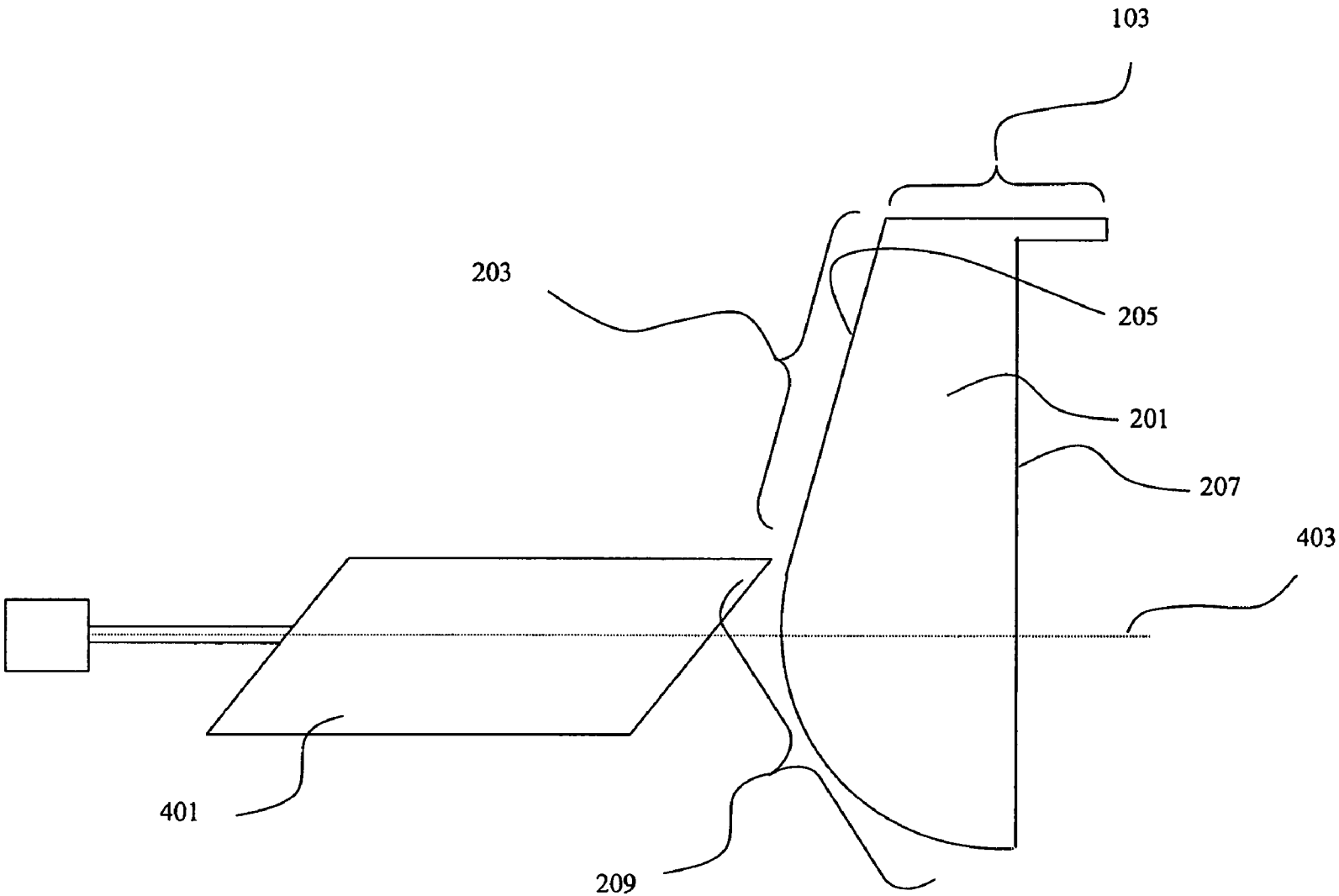
FIG. 7 shows an enlarged cutaway view of a fan ring structure according to still another embodiment of the present invention.

FIG. 7 shows a cross-section of the circumferential periphery profile of the fan ring body 201 having an exterior surface that has a substantially linear outer surface 207 extending perpendicular from the mounting ring 103. FIG. 7 shows the transition portion 203 and the curved portion 209 extending from mounting ring 103, similar to FIG. 6. However, the arc of the curved portion 209 is greater than the arc shown in FIG. 6. The transition portion 203 shown in FIG. 7 extends for a length greater than the length of the curved portion 209.

Figure 8:
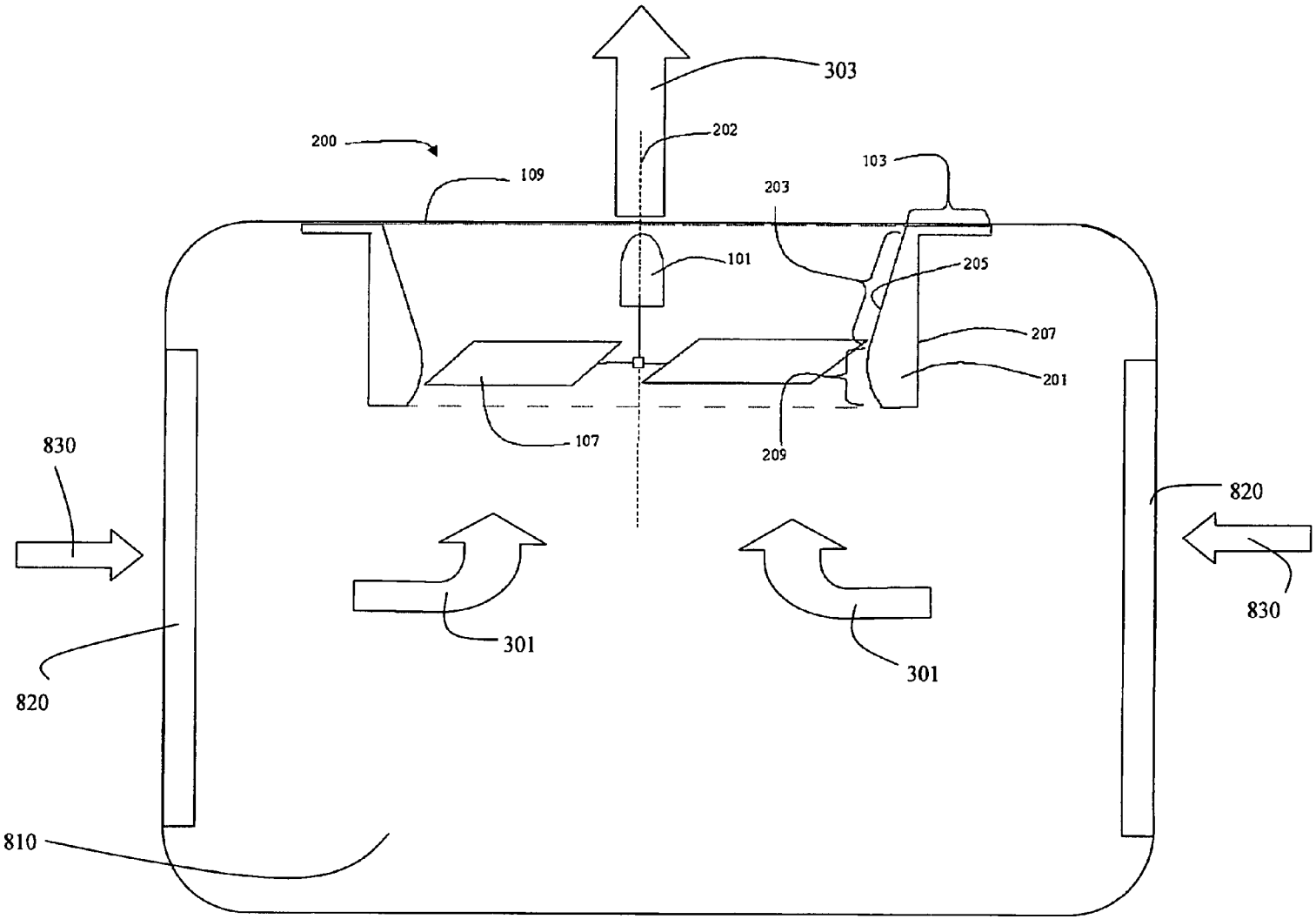
FIG. 8 shows a cutaway view of a heat exchanger unit according to an embodiment of the present invention.

FIG. 8 shows a cross-sectional view of a heat exchanger 810 according to an embodiment of the invention. The heat exchanger 810 includes heat exchanger coils 820 that exchange heat with outdoor air 830. The outdoor air 830 is drawn through the heat exchanger coils 820 by fan 101. Intake air 301 is moved into the fan ring structure 200. Although FIG. 8 shows a fan ring structure, as shown in FIG. 2, the fan ring structure 200, and the fan ring body 201 may have the geometries shown in FIGS. 3-7 or any other geometry that has the extended transition portion 203 and results in noise reduction and increased airflow. The noise reduction is a result of a venturi airflow effect, resulting in reduced recirculation around the intake of the fan ring and less turbulent flow through the fan ring structure 200.

The shape of the extended venturi structure is easily manufactured using conventional manufacturing techniques. In addition, any material suitable for installation into a heat exchanger unit may be used in the fabrication of the fan ring structure 200. Suitable materials for fabrication of the fan ring structure include, but are not limited to metal, metal alloy or polymer materials. The use of conventional manufacturing techniques allows the fan ring structure to be produced inexpensively. Suitable manufacturing techniques include, but are not limited to, metal-working, machining, shaping, injection molding or any other metal or polymer shape-forming method.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. A fan ring for use with a heat exchanger comprising:

an annular fan ring body attached to a coaxial mounting ring, the fan ring body and mounting ring having a center axis;

the fan ring body extending in a substantially perpendicular direction from an inner periphery of the mounting ring;

the fan ring body having a circumferential periphery profile defined by a plane coincident the center axis;

the periphery profile at an inner surface of the fan ring body includes:

a transition portion and a curved portion;

the transition portion extending in a substantially perpendicular direction from the mounting ring and attaching to an end of the curved portion;

wherein the length of the curved portion of the periphery profile is sufficient to reduce recirculation of air entering the fan ring body;

wherein a ratio of a length of the transition portion along the periphery profile to a length of the curved portion along the periphery profile is greater than about 1:1 and a fan arranged and disposed such that a fan blade centerline intersects the curved portion at a point near a minimum diameter of the inner surface of the fan ring body.

2. The fan ring of claim 1, wherein the curved portion has a semi-elliptical geometry.

3. The fan ring of claim 1, wherein the fan ring body is formed from a material selected from the group consisting of metal, metal alloy and polymer.

4. The fan ring of claim 1, wherein the transition portion of the circumferential periphery profile forms a frusto-conical geometry.

5. The fan ring of claim 1, wherein the fan ring body comprises an outer surface that extends perpendicularly from the mounting ring and substantially parallel to the center axis.

6. The fan ring of claim 1, wherein the fan ring body comprises an outer surface that extends perpendicularly from the mounting ring and has a geometry substantially identical to the inner surface.

7. A heat exchanger unit comprising an annular fan ring body attached to a coaxial mounting ring, the fan ring body and mounting ring having a center axis;

the fan ring body extending in a substantially perpendicular direction from an inner periphery of the mounting ring;

the fan ring body having a circumferential periphery profile defined by a plane coincident the center axis;

the periphery profile at an inner surface of the fan ring body includes:

a transition portion and a curved portion;

the transition portion extending in a substantially perpendicular direction from the mounting ring and attaching to an end of the curved portion;

a fan having one or more fan blades, the fan blades having a fan blade center axis substantially perpendicular to the center axis; and wherein the fan is arranged and disposed so that the fan blade center axis intersects the curved portion of the periphery profile at a point where the curved portion defines a minimum inner diameter for the fan ring body; and wherein a ratio of a length of the transition portion along the periphery profile to a length of the curved portion along the periphery profile is greater than about 1:1.

8. The heat exchanger unit of claim 7, wherein the curved portion has a semi-elliptical geometry.

9. The heat exchanger unit claim 7, wherein the fan ring body is formed from a material selected from the group consisting of metal, metal alloy and polymer.

10. The heat exchanger of claim 7, wherein the transition portion of the circumferential periphery profile forms a frusto-conical geometry.

11. The heat exchanger unit of claim 7, wherein the fan comprises swept-wing fan blades.

12. The heat exchanger unit of claim 7, wherein the fan ring body comprises an outer surface that extends perpendicularly from the mounting ring and substantially parallel to the center axis.

13. The heat exchanger unit of claim 7, wherein the fan ring body comprises an outer surface that extends perpendicularly from the mounting ring and has a geometry substantially identical to the inner surface.

14. The heat exchanger unit of claim 7, further comprising a heat exchanger coil arranged and disposed upstream from the fan, wherein flow of air through the heat exchanger coil is substantially uniform.

15. A fan ring for use with a heat exchanger comprising:

an annular fan ring body attached to a coaxial mounting ring, the fan ring body and mounting ring having a center axis;

the fan ring body extending in a substantially perpendicular direction from an inner periphery of the mounting ring;

the fan ring body having a circumferential periphery profile defined by a plane coincident the center axis;

the periphery profile at an inner surface of the fan ring body includes:

a transition portion and a curved portion;

the transition portion extending in a substantially perpendicular direction from the mounting ring and attaching to an end of the curved portion;

wherein the length of the curved portion of the periphery profile is sufficient to reduce recirculation of air entering the fan ring body;

wherein the curved portion has a predetermined radius of curvature;

wherein the radius of curvature of the curved portion includes about 1.4 to about 1.6; and a fan arranged and disposed such that a fan blade centerline intersects the curved portion at a point near a minimum diameter of the inner surface of the fan ring body.

16. A fan ring for use with a heat exchanger comprising:

an annular fan ring body attached to a coaxial mounting ring, the fan ring body and mounting ring having a center axis;

the fan ring body extending in a substantially perpendicular direction from an inner periphery of the mounting ring;

the fan ring body having a circumferential periphery profile defined by a plane coincident the center axis;

the periphery profile at an inner surface of the fan ring body includes:

a transition portion and a curved portion;

the transition portion extending in a substantially perpendicular direction from the mounting ring and attaching to an end of the curved portion;

wherein the length of the curved portion of the periphery profile is sufficient to reduce recirculation of air entering the fan ring body; and wherein a ratio of a length of the transition portion along the periphery profile to a length of the curved portion along the periphery profile is from about 0.7:1 to about 1.3:1; and a fan arranged and disposed such that a fan blade centerline intersects the curved portion at a point near a minimum diameter of the inner surface of the fan ring body.

17. A heat exchanger unit comprising an annular fan ring body attached to a coaxial mounting ring, the fan ring body and mounting ring having a center axis;

the fan ring body extending in a substantially perpendicular direction from an inner periphery of the mounting ring;

the fan ring body having a circumferential periphery profile defined by a plane coincident the center axis;

the periphery profile at an inner surface of the fan ring body includes:

a transition portion and a curved portion;

the transition portion extending in a substantially perpendicular direction from the mounting ring and attaching to an end of the curved portion;

a fan having one or more fan blades, the fan blades having a fan blade center axis substantially perpendicular to the center axis;

wherein the fan is arranged and disposed so that the fan blade center axis intersects the curved portion of the periphery profile at a point where the curved portion defines a minimum inner diameter for the fan ring body;

wherein the length of the curved portion of the periphery profile is sufficient to reduce recirculation of air entering the fan ring body; and wherein the curved portion has a predetermined radius of curvature; and wherein the radius of curvature of the curved portion includes about 1.4 to about 1.6.

18. A heat exchanger unit comprising an annular fan ring body attached to a coaxial mounting ring, the fan ring body and mounting ring having a center axis;

the fan ring body extending in a substantially perpendicular direction from an inner periphery of the mounting ring;

the fan ring body having a circumferential periphery profile defined by a plane coincident the center axis;

the periphery profile at an inner surface of the fan ring body includes:

a transition portion and a curved portion;

the transition portion extending in a substantially perpendicular direction from the mounting ring and attaching to an end of the curved portion;

a fan having one or more fan blades, the fan blades having a fan blade center axis substantially perpendicular to the center axis;

wherein the fan is arranged and disposed so that the fan blade center axis intersects the curved portion of the periphery profile at a point where the curved portion defines a minimum inner diameter for the fan ring body; and wherein a ratio of a length of the transition portion along the periphery profile to a length of the curved portion along the periphery profile is from about 0.7:1 to about 1.3:1.

* * * * *

UNITED STATES PATENT AND TRADEMARK OFFICE

CERTIFICATE OF CORRECTION

PATENT NO. : 7,481,619 B2
APPLICATION NO. : 11/201984
DATED : January 27, 2009
INVENTOR(S) : Charles Borromeo Obosu and Mallikarjuna Sarma Chitti It is certified that error appears in the above-identified patent and that said Letters Patent is hereby corrected as shown below:

Column 2, Line 53, before the text "FIG. 5 shows an enlarged cutaway view of a fan ring" please insert the text --FIG. 4 shows an enlarged cutaway view of a fan ring structure according to another embodiment of the present invention--.

Signed and Sealed this

Eighth Day of September, 2009

David J. Kappos

David J. Kappos
*Director of the United States Patent and Trademark Office*